US005230611A

United States Patent [19]

Shelton

[11] Patent Number: 5,230,611

[45] Date of Patent: Jul. 27, 1993

[54] INFLATOR DEVICE

[76] Inventor: Billy R. Shelton, 5279 Salisbury Dr., Newark, Calif. 94560

[21] Appl. No.: 951,740

[22] Filed: Sep. 25, 1992

[51] Int. Cl.[5] ..... F04B 43/00

[52] U.S. Cl. ..... 417/437; 5/454

[58] Field of Search ..... 417/437, 479; 5/454; 239/601

[56] References Cited

U.S. PATENT DOCUMENTS

| | | | |
|---|---|---|---|
| 1,469,118 | 9/1923 | Speicher | 239/601 X |
| 1,787,153 | 12/1930 | Huffman | 417/437 |
| 2,423,890 | 7/1947 | Hunt | 417/479 X |
| 2,812,525 | 11/1957 | Friedlander | 5/454 X |
| 3,297,241 | 1/1967 | Andréasson | 417/437 X |
| 4,301,948 | 11/1981 | Czech et al. | 417/437 X |
| 4,962,851 | 10/1990 | Schuckmann et al. | 417/437 |

*Primary Examiner*—Richard E. Gluck

*Attorney, Agent, or Firm*—James J. Leary

[57] ABSTRACT

An inflator device which, when attached to a plastic bag, creates a highly efficient air pump for inflating air-inflatable objects, such as boats, air mattresses and inflatable toys. The inflator has a tubular body with a one-way air valve inside of it. One end of the tubular body has a bag attachment fitting with a threaded cap for attaching the device to a plastic bag. The other end has a tapered inflation fitting for inserting into the inflation valve of an inflatable object. To operate the inflator device, the bag attachment fitting is attached to the closed end of a plastic bag and the inflation fitting is inserted into the inflation valve of the object to be inflated. The user fills the plastic bag with air, then closes the end of the bag to trap the air inside. The user presses on the plastic bag with his hands or his body to force the trapped air into the inflatable object. This two-step operation is repeated until the object is fully inflated.

8 Claims, 8 Drawing Sheets

INFLATOR DEVICE

FIELD OF THE INVENTION

This invention relates to an inflator device suitable for inflating air-inflatable objects, such as boats, air mattresses and inflatable toys.

BACKGROUND OF THE INVENTION

Air-inflatable objects are very commonly used for furniture, for transportation, for recreation and for amusement devices and toys. These objects include inflatable boats and rafts, air mattresses, inflatable swimming pools, inflatable chairs, flotation devices, inflatable dolls and animals, and a great many other devices. A variety of air pumps have been devised to assist the user in inflating these objects. These air pumps are generally hand operated, foot operated or electrically operated. The hand operated pumps are mostly variations on the familiar piston-type bicycle pump. Most of the foot operated pumps are bellows-type air pumps. The electrically operated pumps are generally piston or diaphragm pumps that operate on household current or connect to a car battery. Some inflatable objects have their own built-in air pump so that a separate air pump is not needed.

The inventor has found that these prior art pumps are not well suited for many applications because many inflatable objects require large volumes of low pressure air, and every one of the prior art pumps is designed to deliver small volumes of high pressure air. While these pumps are certainly easier to use than mouth-inflating a large inflatable object, the mismatch of the pumps to the task still leaves it a time consuming and tedious task. Even with an electric powered air pump, inflating a large air mattress or boat is a very slow process. Electric pumps also require you to be near an electric power source or battery which are not readily available in many situations, such as cramping and boating. This cuts down greatly on the convenience and portability of electric pumps. What is needed for many applications is a convenient and portable air pump that will quickly and easily deliver large volumes of low pressure air to quickly inflate a large object.

SUMMARY OF THE INVENTION

In keeping with the foregoing discussion, the objective of the present invention is to provide a manual inflation device that is particularly well suited for inflating large air-inflatable objects. To this end, the inflation device must be capable of delivering large volumes of air at low pressure to quickly and easily inflate a large object. The inflation device should be equally well suited for inflating objects of various objects of different sizes and different inflation pressures. Ideally, the inflation device should be convenient, portable, inexpensive, simple to use and require a minimum of effort to operate.

In keeping with these objectives, the present invention takes the form of an inflation device that attaches to any air-impermeable bag, such as an ordinary 30 gallon or 55 gallon plastic bag, to transform it into a highly efficient air pump for inflating air-inflatable objects. The inflation device can be used to quickly and almost effortlessly inflate large inflatable objects that previously required hours of tiresome pumping. The device is small enough that it is easily transported to wherever it is needed, and when it is not in use, it can be stored in a minimum of space. The inflation device is an invaluable tool for campers, backpackers, boaters, sportsmen, parents and anyone else who uses inflatable objects for work or recreation. Other objects and advantages of the invention will become apparent to the reader from a consideration of the following detailed description of the invention along with the accompanying drawings.

DETAILED DESCRIPTION OF THE INVENTION

Figure 1:
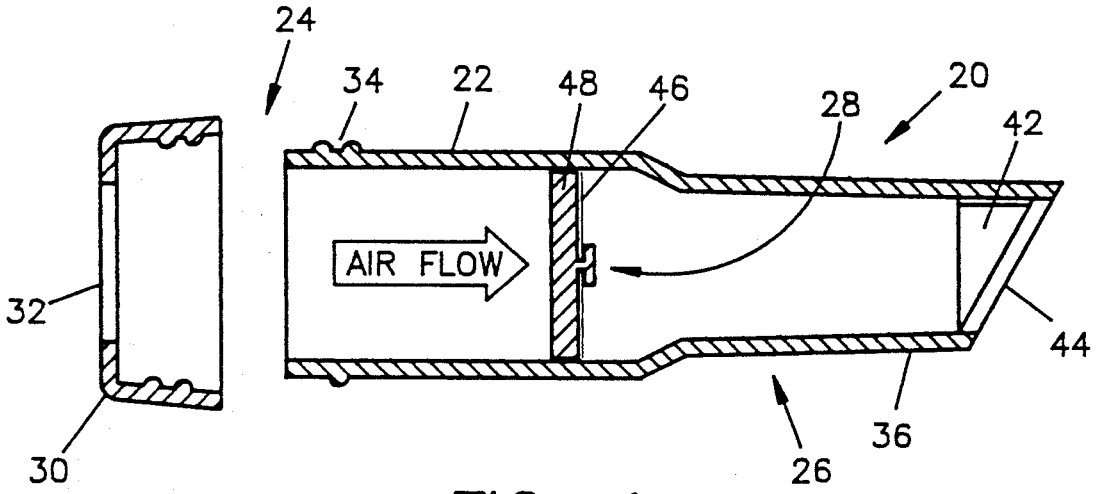
FIG. 1 shows a cross section of an embodiment of the inflator device with a large diameter inflation fitting.

FIG. 1 shows a cross section of an exemplary embodiment of the inflator device of the present invention. The inflator device 20 is made so that it can be combined with a bag made of plastic or other air-impervious material to make a highly efficient air pump. The inflator device 20 is characterized by a tubular body 22 which, on one end, has a bag attachment fitting 24 for attaching the device 20 to a plastic bag and, on the other end, has an inflation fitting 26 for attaching it to the inflation valve of an inflatable object. On the interior of the tubular body 22 is a one-way air valve 28 that allows air flow in one direction only.

Figure 10:
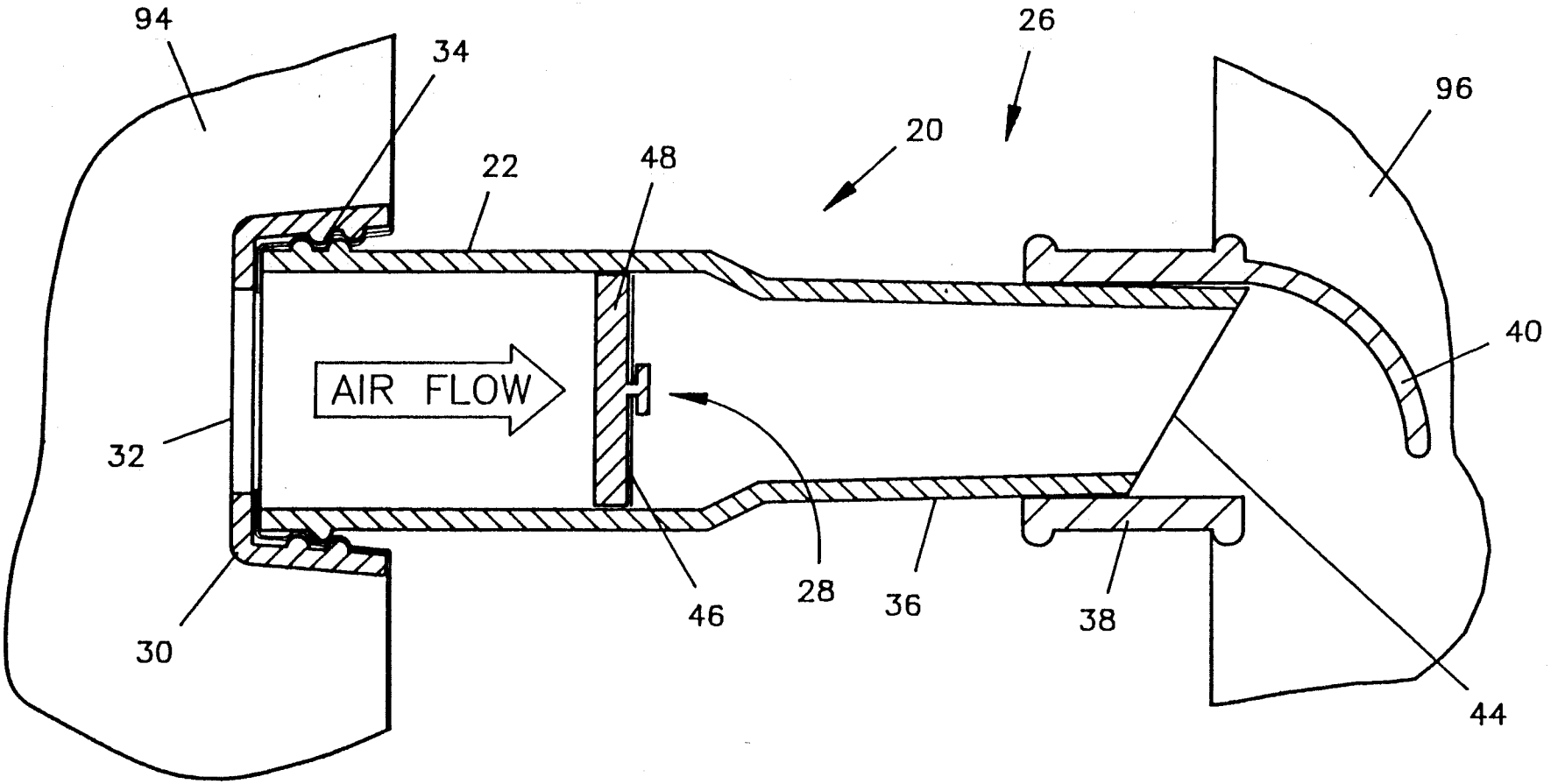
FIG. 10 shows the inflator device inserted into the inflation valve of an inflatable object.

In one preferred embodiment, the bag attachment fitting 24 is a threaded fitting which has a threaded cap 30 with a hole 32 through it that screws onto the threaded end 34 of the tubular body 22. The screw threads on the cap 30 and the end 34 of the tubular body 22, preferably, have a rounded thread profile so that the wall of the plastic bag is not damaged when the fitting 24 is attached. The preferred type of one-way air valve 28 in the device 20 is a flapper valve that has a flexible rubber flapper 46 attached to a spider 48 which supports the flapper 46 inside of the tubular body 22. This type of valve presents very little resistance to airflow through the valve 28 in the forward direction as shown by the arrow, but effectively stops airflow in the reverse direction. Of course, other types of one-way air valves, such as duckbill valves, ball valves or poppet valves, could be used effectively in the device. The inflation fitting 26 on the other end of the tubular body 22 should be matched to the type of inflation valve on the object to be inflated. The inflation fitting 26 shown in this embodiment has a tapered tubular end 36 that fits into and forms an airtight seal with the tubular inflation valves 38 typically found on inflatable objects, as shown in FIG. 10. The fitting 26 has an angled tip 44 that gently pushes the flapper valve 40 inside of the inflation valve 38 aside as it enters the inflation valve 38. Once the tapered end 36 is inserted into the inflation valve 38, the device 20 can be turned 180 degrees to the position shown to hold the flapper valve 40 open. Other types of inflation valves may require different inflator fittings 26. For instance, a threaded fitting could be substituted for the tapered end 36 of the inflator fitting 26 to attach to inflatable objects having threaded inflation valves.

Figure 2:
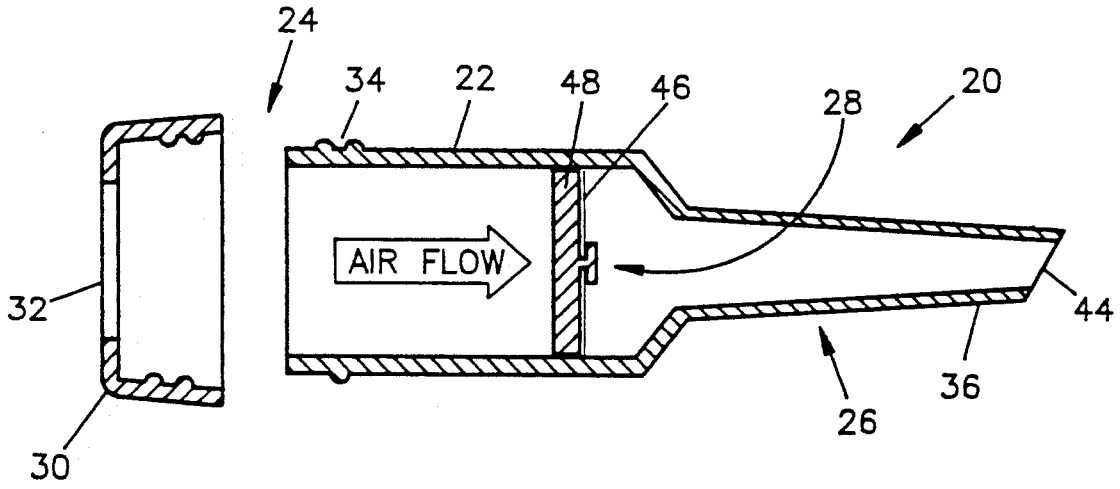
FIG. 2 shows an embodiment of the inflator device with a medium diameter inflation fitting.

FIGS. 2 through 5 show other variations of the inflator device of the present invention. FIG. 2 shows an inflation device that has a smaller diameter tapered end 36 on the inflation fitting 26 to fit inflatable objects with a smaller diameter inflation valve. The tapered end 36 has a simple angled tip 44 without airflow holes to push aside the one-way valve inside of the inflation valve on the inflatable object.

Figure 3:
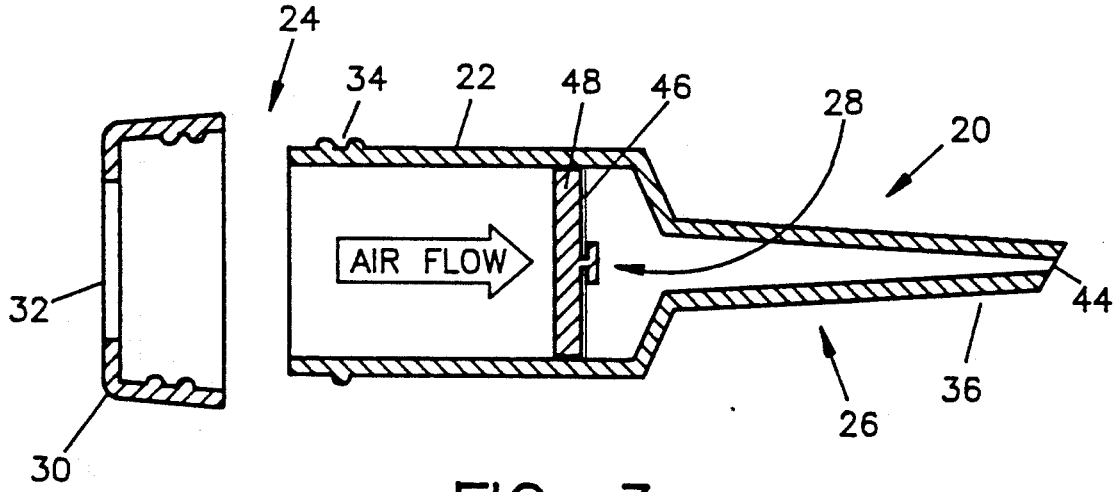
FIG. 3 shows an embodiment of the inflator device with a small diameter inflation fitting.
Figure 4:
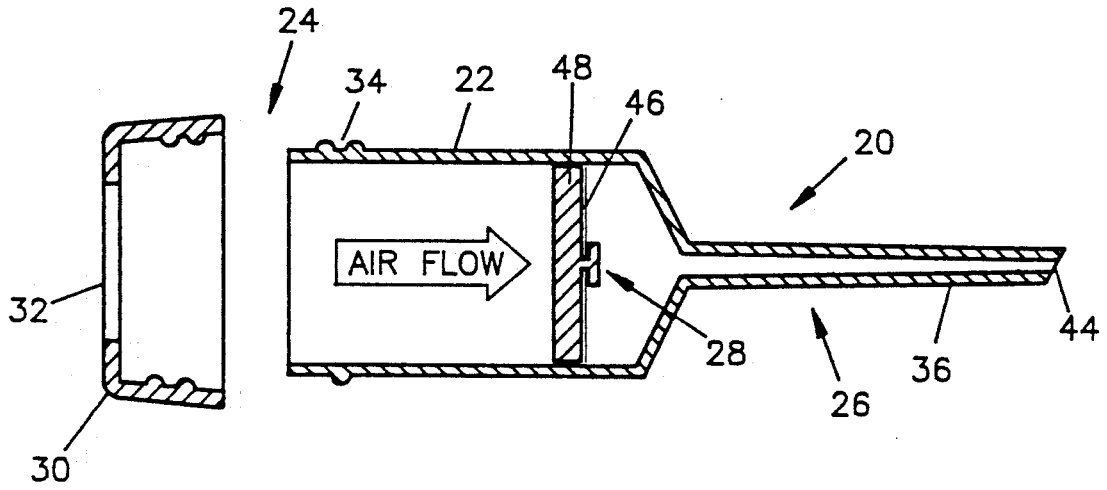
FIG. 4 shows an embodiment of the inflator device with a very small diameter inflation fitting.

FIGS. 3 and 4 show inflator devices with inflation fittings 26 that are even smaller in diameter. Small diameter inflator devices such as these would be useful for inflating objects such as air mattresses and inflatable toys that typically have very small inflation valves. For structural strength and ease of manufacture, these examples are shown without any side holes on the tapered tip 36.

Figure 5:
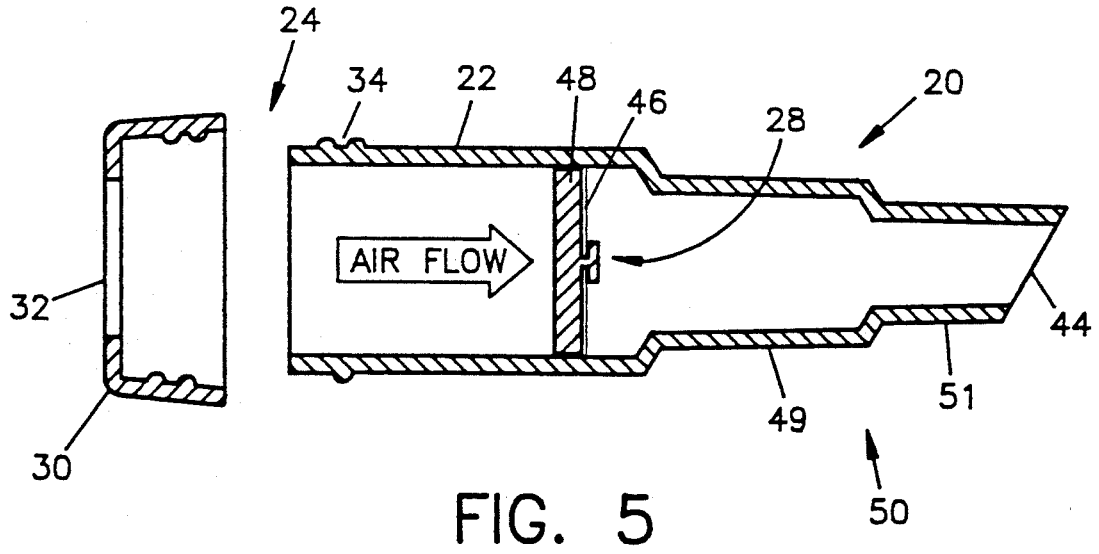
FIG. 5 shows an embodiment of the inflator device with a double-tapered inflation fitting.

FIG. 5 shows a double-tapered variety of the inflator device 20 useful for inflatable objects that have more than one size of inflation valve. This type of inflator device 20 is especially useful for inflating large inflatable rafts that commonly come with a removable one-way valve that can be inserted into the raft's inflation valve. The smaller taper 51 of the double-tapered tip 50 is sized to fit into the one-way valve when it is inserted into the raft's inflation valve. The larger taper 49 of the double-tapered tip 50 is sized to fit directly into inflation valve of the raft when the one-way valve is not used.

Figure 6:
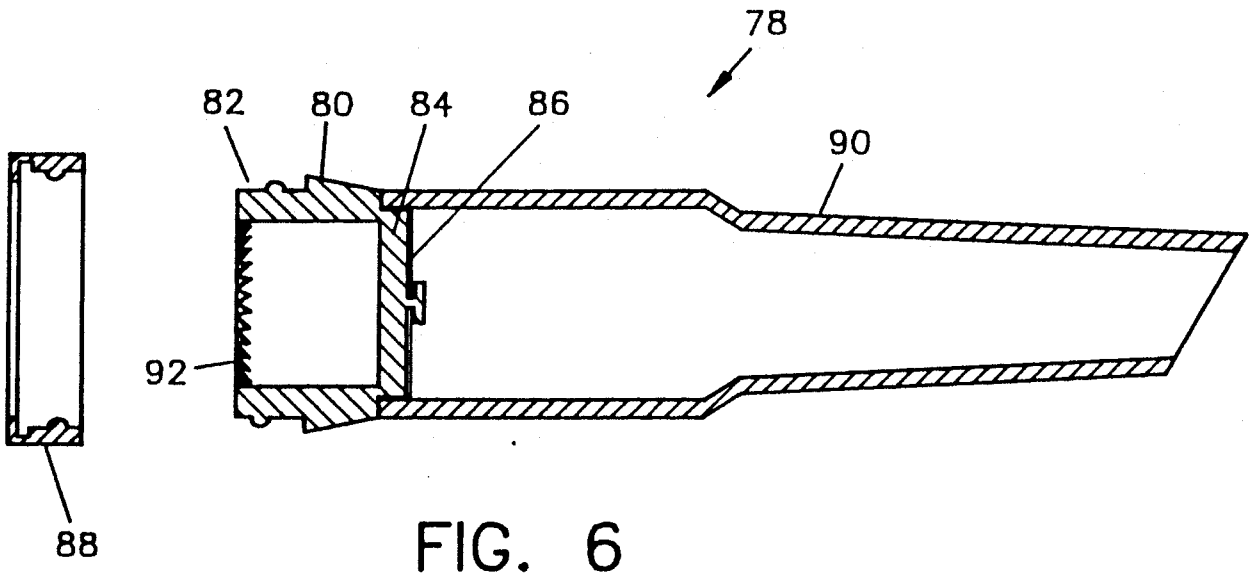
FIG. 6 shows a two-piece modular variation of the inflation device.

FIG. 6 illustrates a modular two-piece variety of the inflator device 78. This variation of the invention is designed for ease of manufacturing. The valve body subassembly 80 can be molded as a single part incorporating the functions of the bag attachment fitting 82 and the spider 84 into one piece that is interchangeable for all sizes of inflator device. A flapper valve 86 and a threaded cap 88 are added to complete the subassembly 80. The valve body subassembly 80 can be combined with any size of inflation fitting 90 to make an inflator device 78. The valve body subassembly 80 and the inflation fitting 90 can be glued or welded permanently together or, with the addition of a threaded attachment, the inflation fitting 90 can be made interchangeable.

Figure 8:
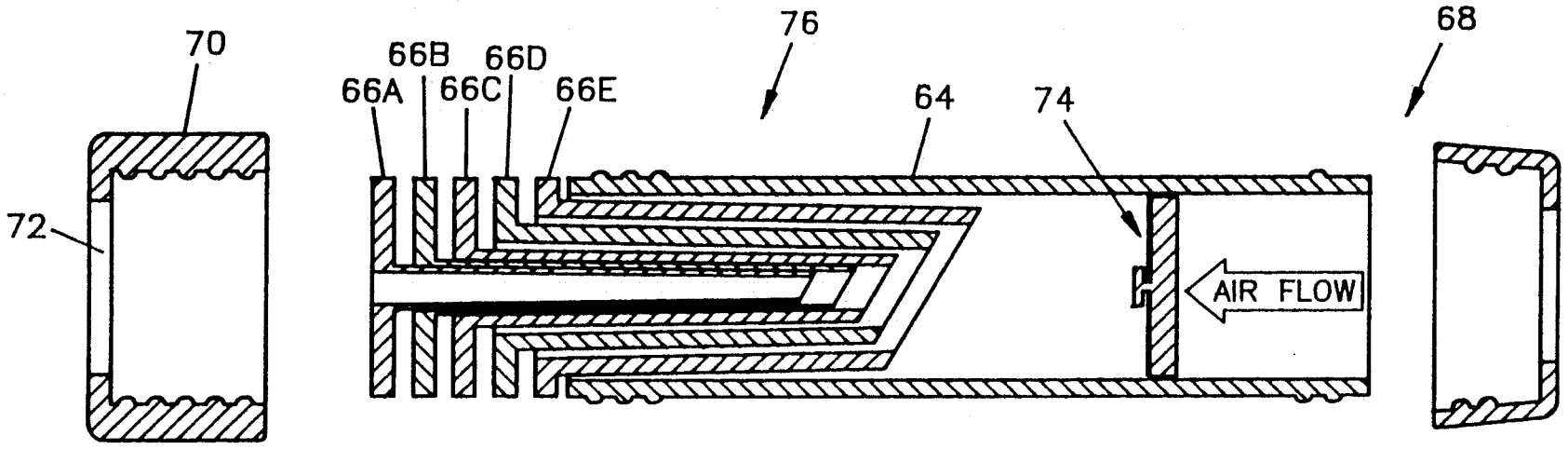
FIG. 8 shows an inflator device with multiple interchangeable inflation fittings.

FIG. 8 shows a variation of the inflator device 76 which is actually a kit containing five interchangeable inflation fittings 66(*a–e*) stored within a tubular inflator body 64. The inflator body 64 has a bag attachment fitting 68 at one end and a threaded cap 70 at the other end. A flapper-type one-way air valve 74 is mounted inside of the tubular body 64. The five interchangeable inflation fittings 66(*a–e*) nest together so that they can all be store inside of the tubular body 64 when they are not in use. To use the inflator device 76, the user begins by unscrewing the threaded cap 70 to remove the inflation fittings 66(*a–e*). The user, then, selects the proper size of inflation fitting 66 and attaches it to the tubular body 64 with the threaded cap 70.

Figure 7:
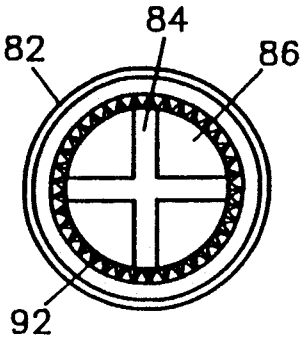
FIG. 7 is an end view of the two-piece modular inflation device.

The cross section of the device 78 in FIG. 6 and the end view of it in FIG. 7 illustrate another feature of the invention which could also be incorporated into any of the examples previously described. Inside of the bag attachment fitting 82 of the device is a serrated edge 92 that aids the user in piercing the wall of the plastic bag after it has been attached to the inflator device 78 by means of the bag attachment fitting 82. The importance of this feature and others will become apparent upon consideration of the operational description which follows the detailed description of the invention.

Figure 9:
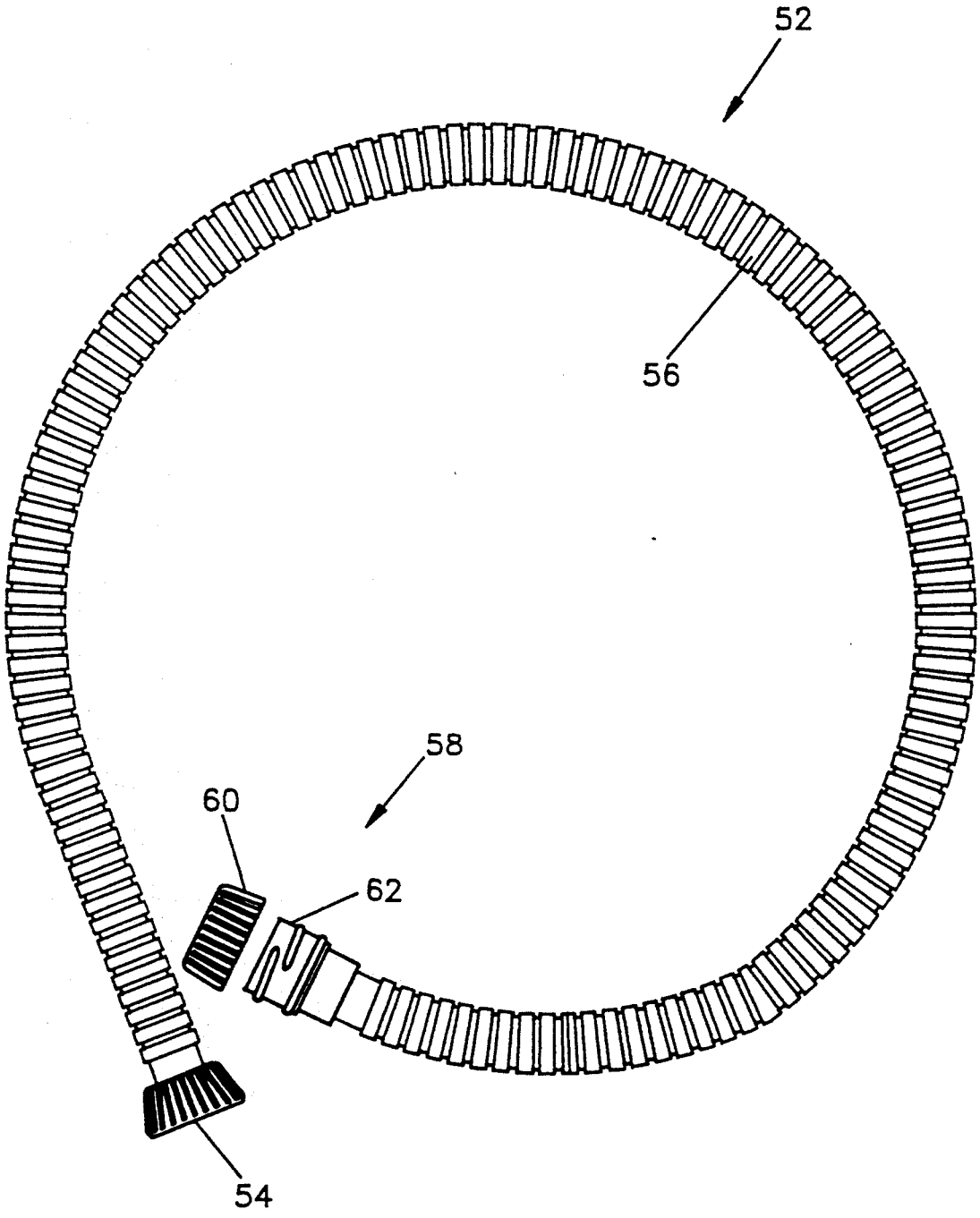
FIG. 9 shows an extension hose for use with the inflation device.

FIG. 9 shows an optional extension hose 52 for use with the inflator device 20. The extension hose 52 is made from a length of flexible tubing 56 that has a bag attachment fitting 58, analogous to the bag attachment fitting 24 on the inflator device 20, at one end and a threaded fitting 54 for attaching it to the threaded end 34 of an inflator device 20 at the other end. It is important to make the extension hose 52 with as large an internal diameter as possible so it does not add any significant resistance to airflow when used with the inflation device.

OPERATIONAL DESCRIPTION

FIG. 10 shows how the inflator device 20 is attached to an air-impermeable bag 94 to create a highly efficient air pump for inflating an air-inflatable object. To begin, the user attaches the inflator device 20 to a bag 94 by means of the bag attachment fitting 24. Almost any type of air-impervious bag can be used with the device. The inventor has found that an ordinary 30 gallon or 55 gallon plastic bag is effective and economical for use with the device. The threaded cap 30 is unscrewed from the threaded end 34 of the tubular body 22 and the threaded end 34 of the device 20 is placed against the wall of the plastic bag 94, preferably near the bottom of the bag 94. Then, the user reaches inside the plastic bag 94 with the threaded cap 30 and screws the threaded cap 30 back onto the threaded end 34 of the tubular body 22 with the wall of the plastic bag 94 in between. This forms an airtight seal between the wall of the plastic bag 94 and the tubular body 22 of the inflator 20. Once the seal is made, the user then reaches through the hole 32 in the end of the threaded cap 30 and tears out the small circle of plastic from the bag 94 that covers the hole 32. Now, there is a fluid communication between the inflator device 20 and the plastic bag 94 with an airtight seal where they are joined together by the bag attachment fitting 24. The serrated edge 92 inside the threaded end 82 of the device 78 shown in FIGS. 6 and 7, can assist the user in piercing the wall of the plastic bag 94 and tearing out the small circle of plastic. If the user desires to reuse the bag 94 for inflating a number of different objects or to use it repeatedly over an extended period of time, a heavy duty plastic bag with a wall thickness greater than three mils can be used, or the wall of the bag 94 can be reinforced with adhesive tape in the region where the bag attachment fitting 24 will be attached. Once the device 20 is attached to the plastic bag 94, the inflation fitting 26 is inserted into the inflation valve 38 of the inflatable object as shown. The tapered end 36 makes an airtight seal with the inflation valve 38 and the angled tip 44 of the fitting 26 holds open the flapper 40 of the one-way valve that may be found inside the inflation valve 38.

Figure 11:
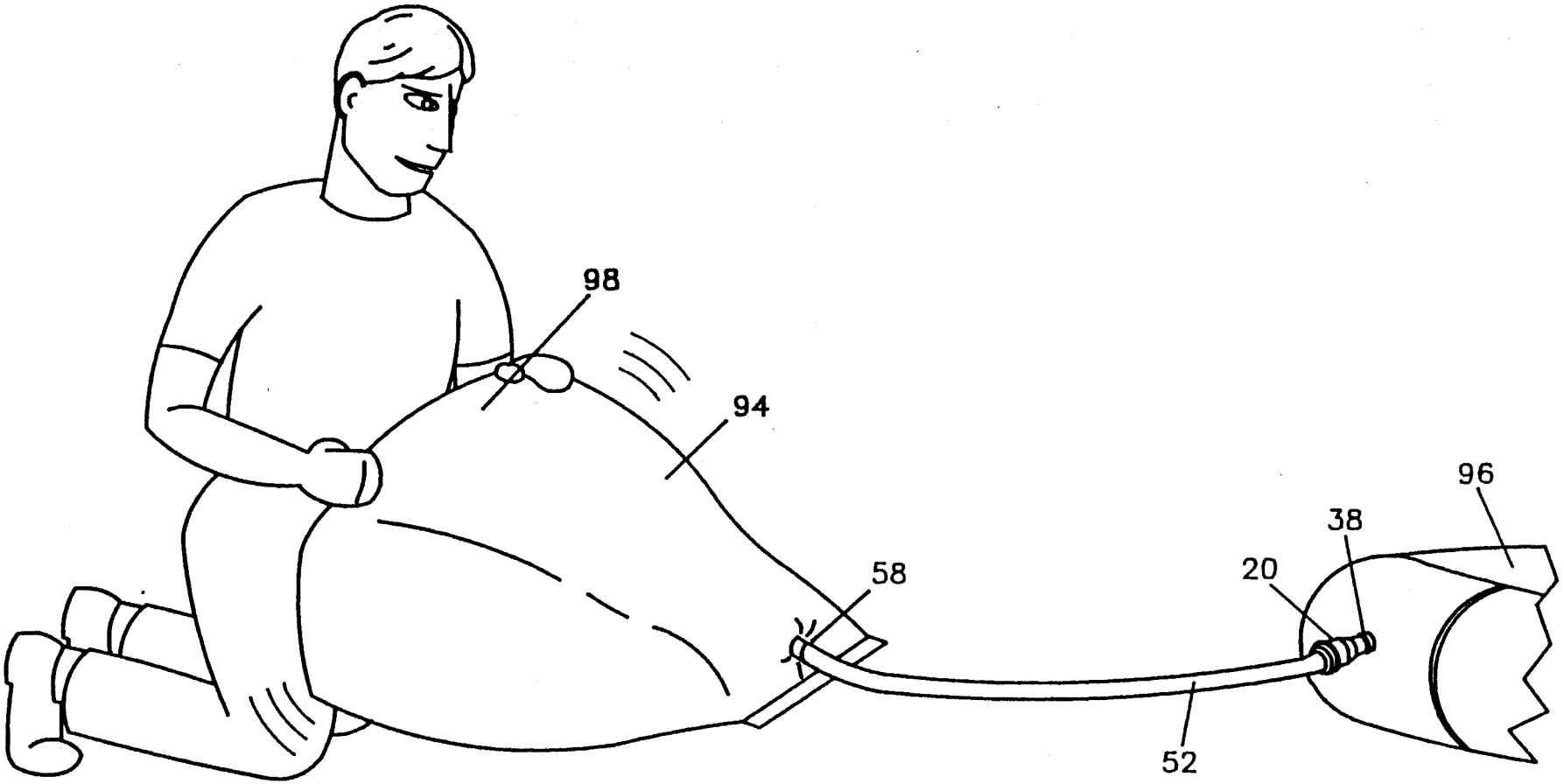
FIG. 11 illustrates a user filling the air bag of the inflation device with air.
Figure 12:
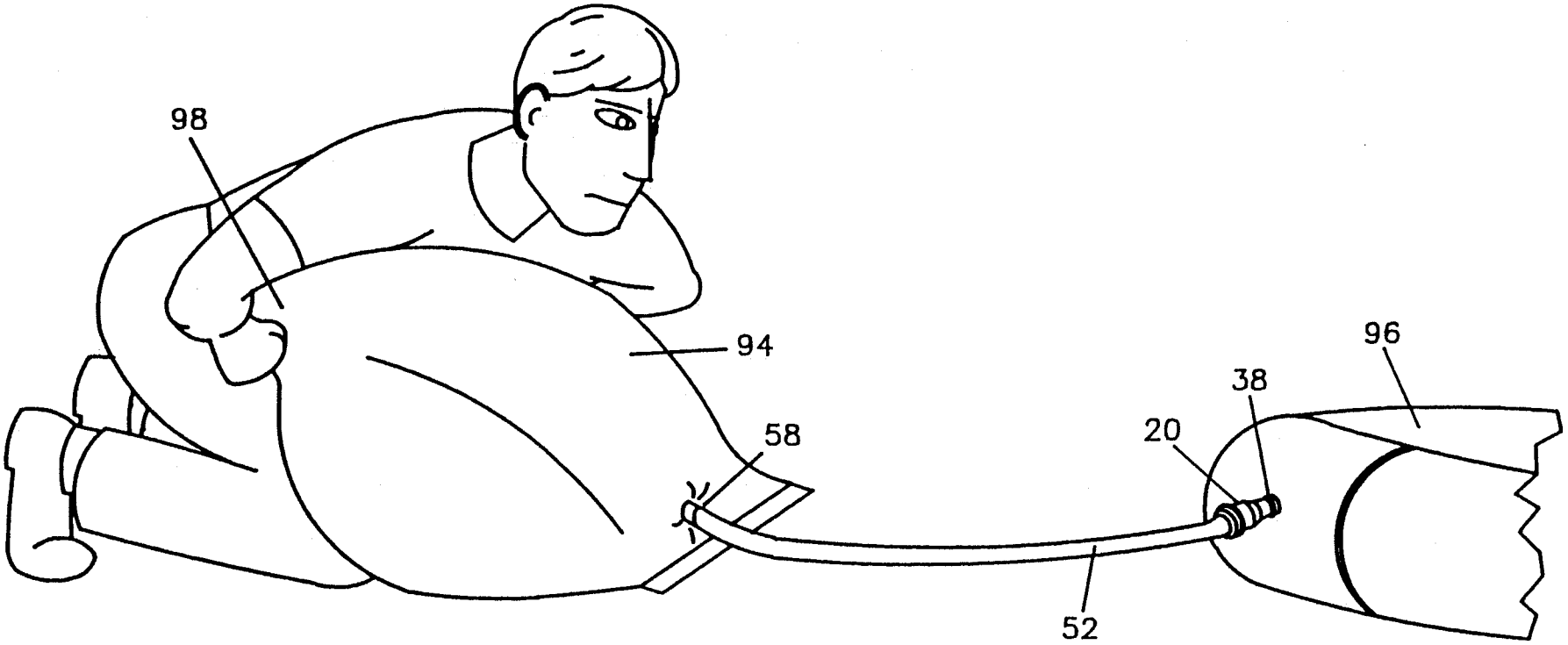
FIG. 12 illustrates a user filling an inflatable boat with air with the help of the inflation device.

FIGS. 11 and 12 show the next two steps of the inflation process. FIGS. 11 and 12 also show the use of the optional extension hose 52 illustrated in FIG. 9. The extension hose 52 may be attached intermediate the plastic bag 94 and the inflator device 20. The bag attachment fitting 58 on the end of the extension hose 52 is attached to the plastic bag 94 in the manner described above, and the threaded fitting 54 on the opposite end of the extension hose 52 is screwed onto the threaded end 34 of the inflator device 20. Then, the inflation fitting 26 of the inflator device 20 is inserted into the inflation valve 38 of an inflatable object 96, such as the inflatable boat shown in the illustrations.

To begin inflating, the user grasps the edge of the plastic bag 94 near the open end 98 and fluffs the bag 94 to capture as much air as possible, as shown in FIG. 11. This part of the operation is even easier if there is a wind, even if it is only a small breeze. The user need only position the top of the bag 94 into the wind and the bag 94 will automatically fill with air when he lifts the edge of the open end 98. After the bag 94 is filled with air, the user closes the end 98 of the bag 94 by gathering it or rolling and folding the open end 98 of the bag 94. Some users may want to employ a clip or other closure means on the end 98 of the bag 94 to hold it closed. The air trapped inside the bag 94 is forced into the inflatable object 96 by pressing on the bag 94 with the hands or the body, as shown in FIG. 12. This two-step operation is repeated as many times as necessary to inflate the object. When the air-inflatable object 96 is sufficiently inflated with air, the inflator device 20 can be removed and the inflation valve 38 closed to hold the air inside.

If the object 96 being inflated needs to be inflated to a higher pressure after it has been inflated as far as possible with low pressure air using the procedure described above, the user can increase the pressure of the air delivered by simply decreasing the volume of air introduced into the bag 94 before pressing on it. When the same force is applied to the smaller volume of air, the result is higher air pressure inside the bag 94. In either case, once the air-inflatable object 96 is sufficiently inflated with air, the inflator device 20 can be removed and the inflation valve 38 closed to hold the air inside.

The method used with the inflator device requires very little effort on the part of the user. The user's own weight does most of the work. It is about as tedious as fluffing a pillow and lying on it several times. This is a remarkable improvement over the prior art devices which often required hours of tedious pumping to inflate a large object. The inventor has found that this device is even preferable to using an electric powered air pump to inflate objects. Nearly all of the portable electric inflation pumps currently on the market are designed to deliver small volumes of air at high pressure. So, while electric pumps may reduce the effort of inflating an object, they seldom reduce the time required. Because it can deliver 30 to 55 gallons or more of air per stroke, the inflator device of the present invention easily beats most electric pumps at inflating a large object, with very little effort expended.

Although the examples given include many specificities, they are intended as illustrative of only some of the possible embodiments of the invention. The inflator device of this invention could be made with any combination or subcombinations of the features described within this specification. Other embodiments and modifications will, no doubt, occur to those skilled in the art. For instance, the bag attachment fitting of the inflator device may take many possible forms other than the threaded fitting described. Fittings that attach to the bag with a friction-fit cap or ring can be substituted for the threaded fitting, or a special clamp could be devised. The device could even be permantly attached to an air-impermeable bag, as by welding or gluing. In this case, the bag could serve a second purpose when not in use as an air pump, such as a storage bag or an inflatable seat for a raft. Likewise, the inflator device can be permanently built into an inflatable object so that it is conveniently available when needed. Though it would decrease the efficiency of the device, the inflator could even be made without the one-way air valve and still be highly effective. Thus, the examples given should only be interpreted as illustrations of some of the preferred embodiments of the invention, and the full scope of the invention should be determined by the appended claims and their legal equivalents.

I claim:

1. An inflator device comprising:

a tubular body having a first end and a second end, a means for sealingly attaching said first end of said tubular body to an air-impermeable bag comprising, screw threads formed on said first end of said tubular body and a threaded cap having a hole there through, such that, when a wall of said bag is interposed between said first end and said threaded cap and said threaded cap is screwed onto said first end, an airtight seal is formed between said air-impermeable bag and said first end of said tubular body, and a means for sealingly attaching said second end of said tubular body to an air-inflatable object.

2. The inflator device of claim 1 further comprising a one-way air valve disposed within said tubular body, said one-way air valve allowing air to flow through said tubular body from said first end to said second end and preventing air from flowing through said tubular body in the reverse direction.

3. The inflator device of claim 1, wherein said means for sealingly attaching said second end of said tubular body to an air-inflatable object comprises a tapered tubular end on said second end of said tubular body adapted to be inserted into an inflation valve of an air-inflatable object, thereby forming an airtight seal between said air-inflatable object and said second end of said tubular body.

4. An inflator device comprising:

a tubular body having a first end and a second end, a means for sealingly attaching said first end of said tubular body to an air-impermeable bag, a means for sealingly attaching said second end of said tubular body to an air-inflatable object comprising, at least one tubular extension having a first end which is removably attachable to said second end of said tubular body, and a second end having means for sealingly attaching said second end of said tubular extension to an air-inflatable object.

5. The inflator device of claim 1 comprising a plurality of interchangeable tubular extensions, each of said tubular extensions having a first end which is removably attachable to said second end of said tubular body, and a second end having means for sealingly attaching said second end of said tubular extension to an air-inflatable object.

6. The inflator device of claim 5 wherein said plurality of interchangeable tubular extensions are adapted to be nested together and stored within said tubular body.

7. The inflator device of claim 4 further comprising a one-way air valve disposed within said tubular body, said one-way air valve allowing air to flow through said tubular body from said first end to said second end and preventing air from flowing through said tubular body in the reverse direction.

8. An inflator device comprising:

a tubular body having a first end and a second end, said first end of said tubular body having screw threads formed thereon, and said second end of said tubular body has a tapered tubular end adapted to be inserted into an inflation valve of an air-inflatable object, thereby forming an airtight seal between said air-inflatable object and said second end of said tubular body, a threaded cap having a hole there through, such that, when a wall of an air-impermeable bag is interposed between said first end and said threaded cap and said threaded cap is screwed onto said first end, an airtight seal is formed between said air-impermeable bag and said first end of said tubular body, and a one-way air valve disposed within said tubular body, said one-way air valve allowing air to flow through said tubular body from said first end to said second end and preventing air from flowing through said tubular body in the reverse direction.

* * * * *